US008672279B2

(12) United States Patent
Schirmacher et al.

(10) Patent No.: US 8,672,279 B2
(45) Date of Patent: Mar. 18, 2014

(54) REVERSIBLE LADDER-MOUNTED SUPPORT AND TRAY

(76) Inventors: Martin Alexander Theodore Schirmacher, Lorton, VA (US); Ralph Lee Pasley, Jr., Catlett, VA (US)

( * ) Notice: Subject to any disclaimer, the term of this patent is extended or adjusted under 35 U.S.C. 154(b) by 250 days.

(21) Appl. No.: 12/929,392

(22) Filed: Jan. 20, 2011

(65) Prior Publication Data

US 2012/0187266 A1 Jul. 26, 2012

(51) Int. Cl.

| | |
|---|---|
| ***E06C 7/14*** | (2006.01) |
| *A47G 29/02* | (2006.01) |
| *E04G 3/20* | (2006.01) |
| *E06B 7/28* | (2006.01) |
| *A47B 85/00* | (2006.01) |
| *A47B 5/00* | (2006.01) |
| *E06C 7/16* | (2006.01) |
| *E06C 1/00* | (2006.01) |
| *E06C 7/00* | (2006.01) |

(52) U.S. Cl.
USPC ..... 248/210; 248/211; 248/238; 248/911; 108/26; 108/47; 182/116; 182/203

(58) Field of Classification Search
USPC ..... 248/238, 210, 211; 182/129, 116, 203; 108/26, 47
See application file for complete search history.

(56) References Cited

U.S. PATENT DOCUMENTS

| | | | | |
|---|---|---|---|---|
| 2,308,805 | A * | 1/1943 | Dahl | 248/211 |
| 2,598,479 | A * | 5/1952 | Wraith | 248/211 |
| 4,424,949 | A * | 1/1984 | Kimmett et al. | 248/238 |
| 4,445,659 | A * | 5/1984 | LaChance | 248/210 |
| 4,489,911 | A * | 12/1984 | Riley | 248/238 |
| 4,515,242 | A | 5/1985 | LaChance | |
| 4,542,874 | A | 9/1985 | Ronning | |
| 4,618,030 | A | 10/1986 | Campbell | |

(Continued)

FOREIGN PATENT DOCUMENTS

| | | | |
|---|---|---|---|
| GB | 2034795 | A * | 6/1980 |
| GB | 2274132 | A * | 7/1994 |

OTHER PUBLICATIONS

Werner Products Model AC24 Multipurpose Project Tray.
Werner Products Model AC18MT—Platform.

(Continued)

*Primary Examiner* — Daniel J Troy
*Assistant Examiner* — Muhammad Ijaz

(57) ABSTRACT

A reversible ladder-mounted support and tray has a bracket designed to be removably affixed to the combination of a rail of a ladder and over a rung just adjacent to the rail. A first fitting is provided that overlies the rail and a second fitting overlies the rung. Concerning the second fitting overlying the rung, in fact, two such fittings are also provided that are essentially back-to-back. In this way, the support may be removably installed on either of the opposed rails of the ladder so that the support can extend laterally to either side of the ladder. Attached to the first fitting designed to overlie the rail is an elongated rod to which is mounted an elongated tube or sleeve having a split and a locking mechanism. The split allows the tube to slide freely over the rod and the locking mechanism may be engaged to narrow the split to lock the position and orientation of the tube thereon. A limit stop mechanism may be employed between the rod and tube or sleeve to limit the degree of rotation of the tube with respect to the rod.

10 Claims, 9 Drawing Sheets

(56) References Cited

U.S. PATENT DOCUMENTS

| | | | | | |
|---|---|---|---|---|---|
| 4,972,923 | A | | 11/1990 | Krause | |
| 5,005,668 | A | | 4/1991 | Nowlan | |
| 5,020,757 | A | * | 6/1991 | Sulecki et al. | 248/238 |
| 5,031,723 | A | | 7/1991 | Hooten | |
| 5,044,466 | A | | 9/1991 | Jacobsmeyer, Jr. | |
| 5,052,581 | A | * | 10/1991 | Christ et al. | 220/570 |
| 5,079,795 | A | | 1/1992 | Schmid | |
| 5,135,193 | A | | 8/1992 | Parris | |
| 5,191,954 | A | | 3/1993 | Ledford | |
| 5,275,256 | A | | 1/1994 | Ellzey | |
| 5,316,252 | A | * | 5/1994 | Charnow et al. | 248/224.51 |
| 5,429,205 | A | | 7/1995 | Collins | |
| 5,461,752 | A | | 10/1995 | Lemon et al. | |
| 5,836,420 | A | | 11/1998 | Marky, Jr. | |
| 5,855,346 | A | | 1/1999 | Hall | |
| 5,960,905 | A | | 10/1999 | Gardner | |
| 5,971,103 | A | | 10/1999 | Mulvaney | |
| 6,045,102 | A | | 4/2000 | Terenzoni | |
| 6,105,911 | A | * | 8/2000 | Olexson | 248/211 |
| 6,148,958 | A | | 11/2000 | Ahl et al. | |
| 6,189,652 | B1 | | 2/2001 | Brown et al. | |
| 6,352,135 | B1 | | 3/2002 | Jones | |
| 6,412,601 | B1 | | 7/2002 | Schmidt | |
| 6,443,260 | B1 | | 9/2002 | Katz et al. | |
| 6,502,664 | B1 | | 1/2003 | Peaker, Sr. | |
| 6,565,051 | B2 | | 5/2003 | Vaglica | |
| 6,688,570 | B1 | | 2/2004 | Mundt | |
| 6,691,825 | B2 | | 2/2004 | Haig | |
| 6,824,115 | B1 | | 11/2004 | Batson | |
| 6,966,406 | B2 | | 11/2005 | Nash, Jr. | |
| 7,000,876 | B2 | | 2/2006 | Searcy | |
| 7,032,711 | B1 | | 4/2006 | Katz et al. | |
| 7,063,187 | B1 | | 6/2006 | Lavigne | |
| 7,077,238 | B2 | | 7/2006 | Butler et al. | |
| 7,374,018 | B1 | | 5/2008 | Thrun | |
| 7,913,964 | B1 | * | 3/2011 | Kennedy | 248/211 |
| 8,469,148 | B2 | * | 6/2013 | Perry | 182/129 |
| 2007/0154260 | A1 | * | 7/2007 | Lindley | 404/114 |
| 2012/0061179 | A1 | * | 3/2012 | English | 182/121 |
| 2012/0080655 | A1 | * | 4/2012 | Coffin | 256/19 |

OTHER PUBLICATIONS

Werner Products Model AC22—Paint Can/Bucket Hanger for Extension Ladders.

* cited by examiner

REVERSIBLE LADDER-MOUNTED SUPPORT AND TRAY

BACKGROUND OF THE INVENTION

The present invention relates to a reversible ladder-mounted support and tray. In the prior art, it is known to provide a ladder with a separate detachable tray that is mounted on the ladder in any one of a variety of ways. Some such devices rely upon the openings within the ladder's rungs to support such a tray using an elongated rod. Others rely upon the rungs themselves to hang a support for a tray. Still others rely upon the side rails of the ladder or combinations of the side rails, rungs and openings through rungs for support purposes.

The following prior art is known to Applicants:

U.S. Pat. No. 4,424,949 to Kimmett et al. discloses a paint tray support that includes a bracket attachable over a rail and a rung of a ladder and supports a paint tray. The present invention differs from the teachings of Kimmett et al. as being reversible and using a differing mechanism of attachment.

U.S. Pat. No. 4,515,242 to LaChance discloses a reversible movable hand railing and tray for ladders including a bracket designed to releasably attach over a rail and two rungs of a ladder. The present invention differs from the teachings of LaChance as contemplating a differing mechanism of attachment and reversal and as having a different means for tray pivoting.

U.S. Pat. No. 5,135,193 to Parris discloses a reversible tray for hollow-rung ladders including an elongated rod insertable into the passageway through a rung and including a secondary bracket mechanism that engages an opening in a second rung to hold the support in place. The present invention differs from the teachings of Parris as contemplating a differing mechanism of releasable attachment and reversal and as having a different mechanism for tray pivoting.

U.S. Pat. No. 5,191,954 to Ledford discloses a ladder rung supported combination platform and utensil rack which relies upon the opening in a rung and two rungs to support a laterally located tray. The present invention differs from the teachings of Ledford as contemplating a differing means of attachment and as being reversible.

SUMMARY OF THE INVENTION

The present invention relates to a reversible ladder-mounted support and tray. The present invention includes the following interrelated objects, aspects and features:

(1) In a first aspect, the present invention contemplates a bracket designed to be removably affixed to the combination of a rail of a ladder and over a rung just adjacent to the rail. A first fitting is provided that overlies the rail and a second fitting overlies the rung.

(2) Concerning the second fitting overlying the rung, in fact, two such fittings are also provided that are essentially back-to-back. In this way, the inventive support may be removably installed on either of the opposed rails of the ladder so that the support can extend laterally to either side of the ladder. In this way, the inventive device is reversible.

(3) Attached to the first fitting designed to overlie the rail is an elongated rod to which is mounted an elongated tube or sleeve having a split and a locking mechanism. The split allows the tube to slide freely over the rod and the locking mechanism may be engaged to narrow the split to lock the position and orientation of the tube thereon.

(4) A flat plate is preferably fastened to the tube or sleeve and is sized and configured to hold a tray thereon. If desired, the tray may be permanently affixed to the plate or can even integrally include the plate. Alternatively, the tray may be removably fastened to the plate.

(5) A limit stop mechanism may be employed between the rod and tube or sleeve to limit the degree of rotation of the tube with respect to the rod. In one embodiment, the limit stop may consist of an arcuate slot in the tube and a projection in the rod that rides within the slot and limits the degree of rotation of the plate with respect to the rod corresponding to the angle subtended by the slot about the tube.

(6) In the preferred embodiment of the present invention, the component parts thereof are made of any lightweight, strong materials such as aluminum. Other materials such as wood and plastic may also be employed.

As such, it is a first object of the present invention to provide a reversible ladder-mounted support and tray.

It is a further object of the present invention to provide such a device in which a fitting facilitates reversible removable mounting of the support on either rail of a ladder.

It is a still further object of the present invention to provide such a device in which a locking mechanism locks the lateral position and angular relationship of a tray with respect to a ladder.

It is a still further object of the present invention to provide such a device in which a tray is mounted to a tube or sleeve removably mounted over a rod.

It is a yet further object of the present invention to provide such a device in which removable support on a ladder is attained through one fitting engaging a rail of a ladder and another fitting engaging a rung thereof.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
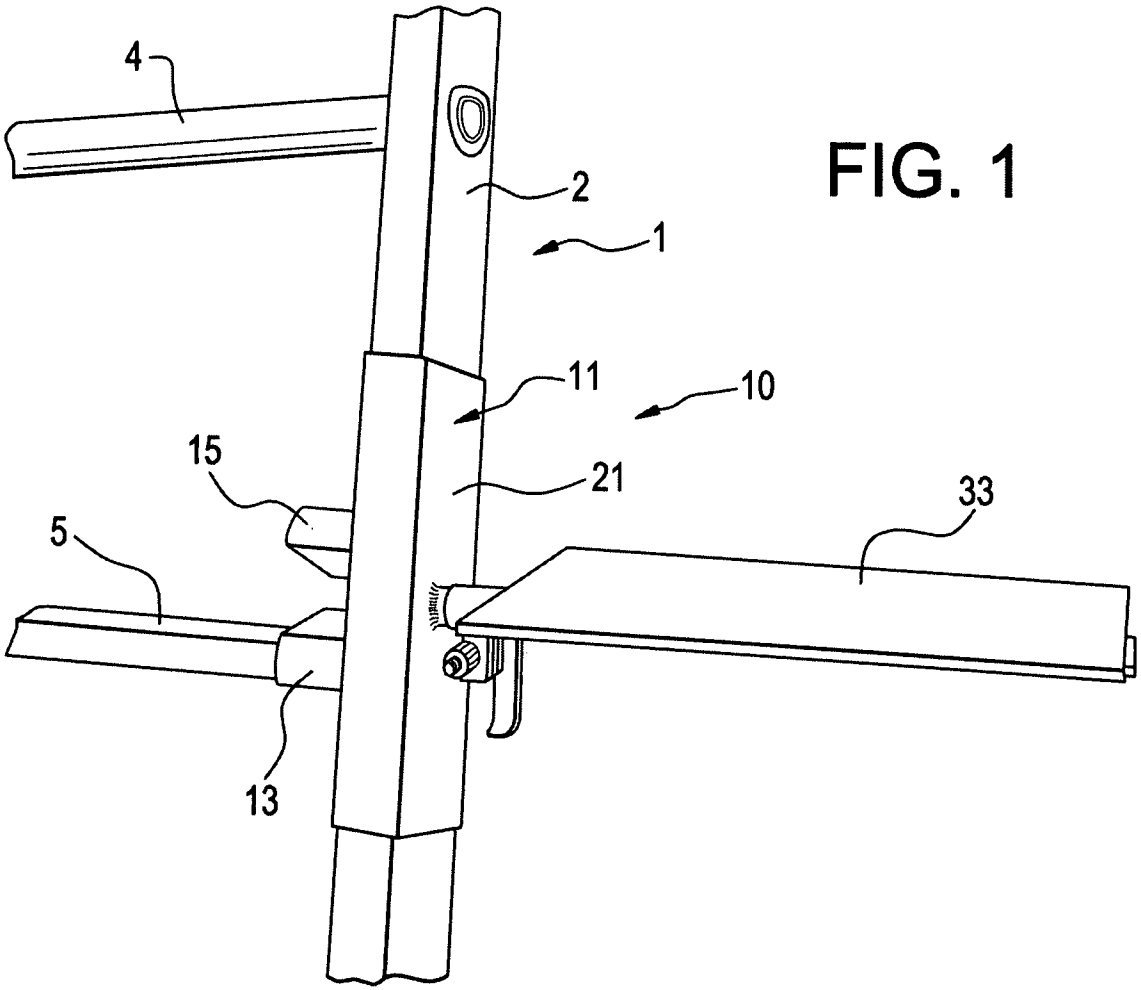
FIG. 1 shows a front side perspective view of the present invention as mounted on a ladder in a first orientation.
Figure 2:
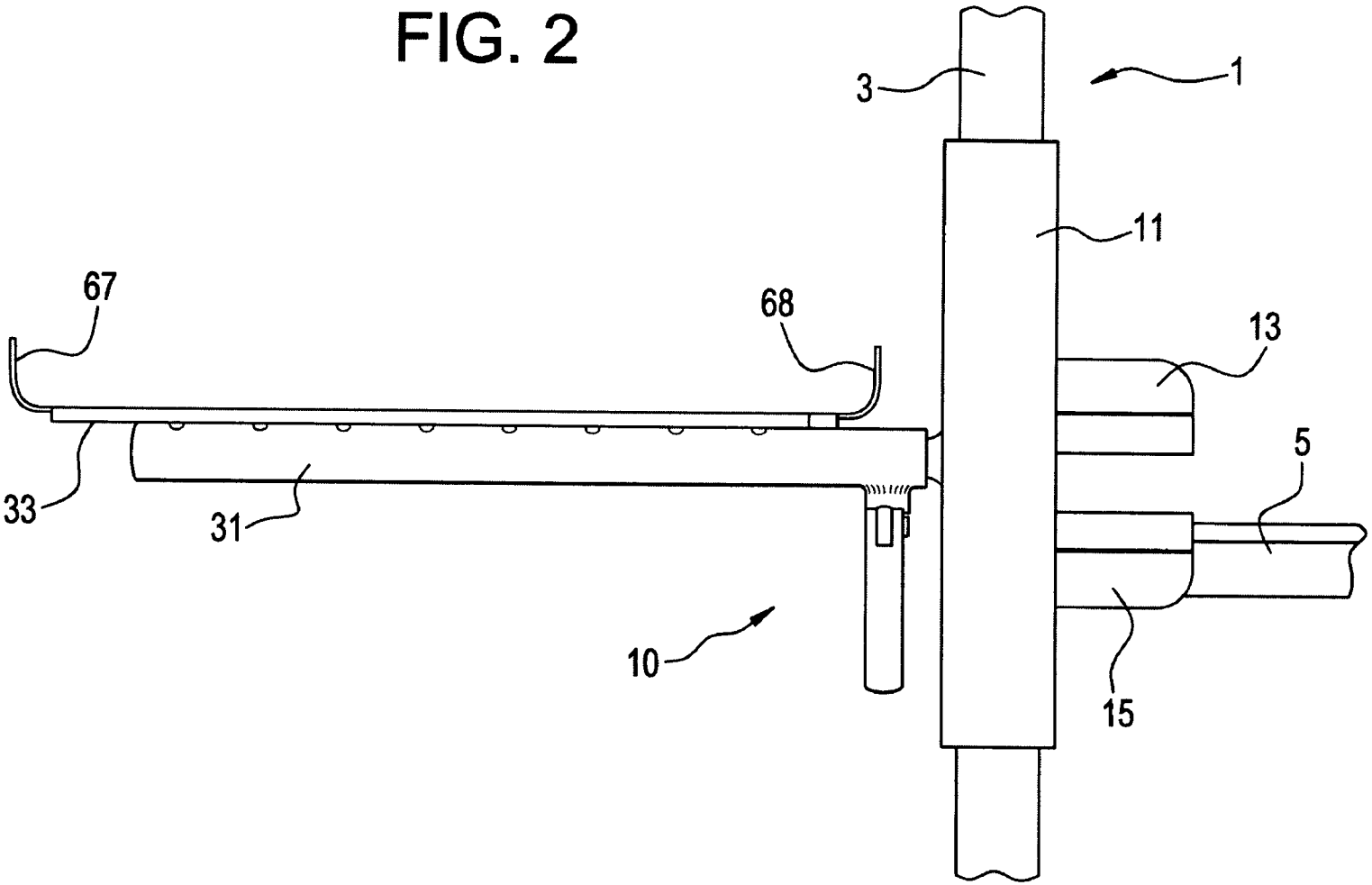
FIG. 2 shows the invention of FIG. 1, but reversed in position with respect to the same ladder.

With reference to FIGS. 1 and 2, a ladder 1 includes a right hand rail 2, a left hand rail 3, and rungs 4 and 5.

Figure 8:
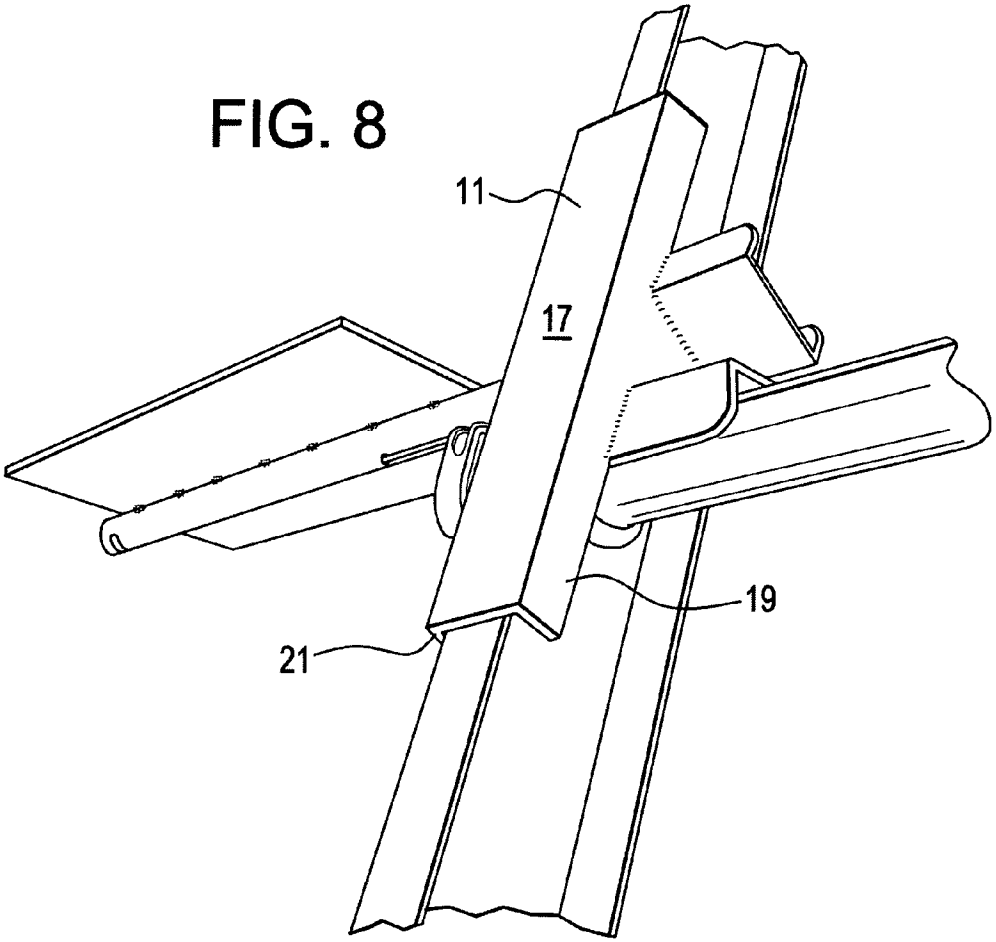
FIG. 8 shows a view similar to that of FIG. 7, but from a lower front perspective.

The present invention is generally designated by the reference numeral 10 and is seen to include a first elongated fitting 11 as well as two second fittings 13 and 15. As seen in the figures, the first fitting 11 is designed to overlie either the rail 2 or the rail 3. As seen in FIG. 8, the first fitting 11 has a J-shaped cross-section including a central side 17 and two parallel sides 19 and 21 perpendicular to the central side. As best seen from comparing FIGS. 4 and 8, the side 21 of the fitting 11 is significantly wider than the side 19. The sides of the fitting 11 permit the fitting 11 to overlie a portion of the rail 2 or 3 of the ladder 1.

With reference, for example, to FIG. 1, with the first fitting 11 engaging the rail 2, the second fitting 13 engages over the rung 5 to hold the inventive device 10 in mounted position.

With reference to FIG. 2, in comparison to FIG. 1, the device 10 is inverted and when the first fitting 11 is mounted over the rail 3 of the ladder 1, the second fitting 15 overlies the rung 5 to mount the inventive device 10 in the position and orientation shown.

Figure 6:
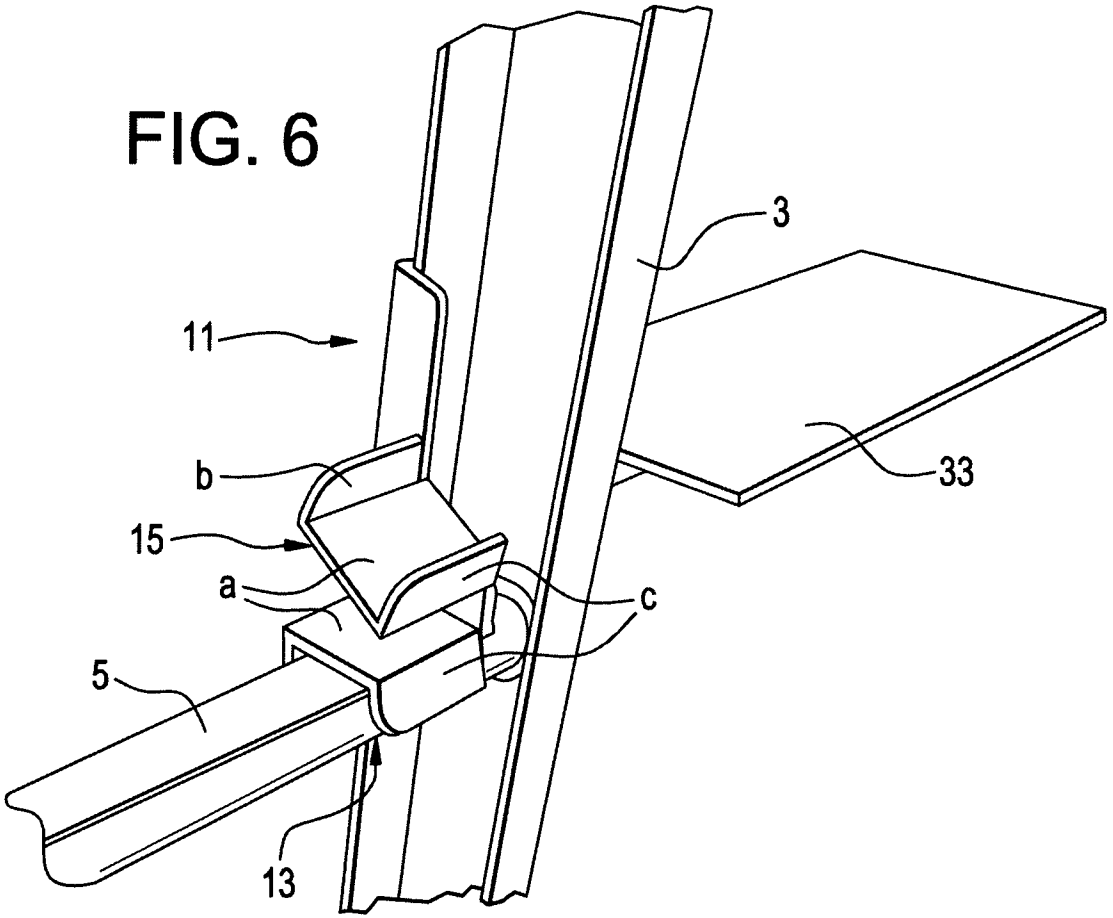
FIG. 6 shows a further upper rear perspective view looking from between the rails of the ladder toward the periphery thereof and showing the inventive device oriented as shown in FIGS. 2-5.
Figure 7:
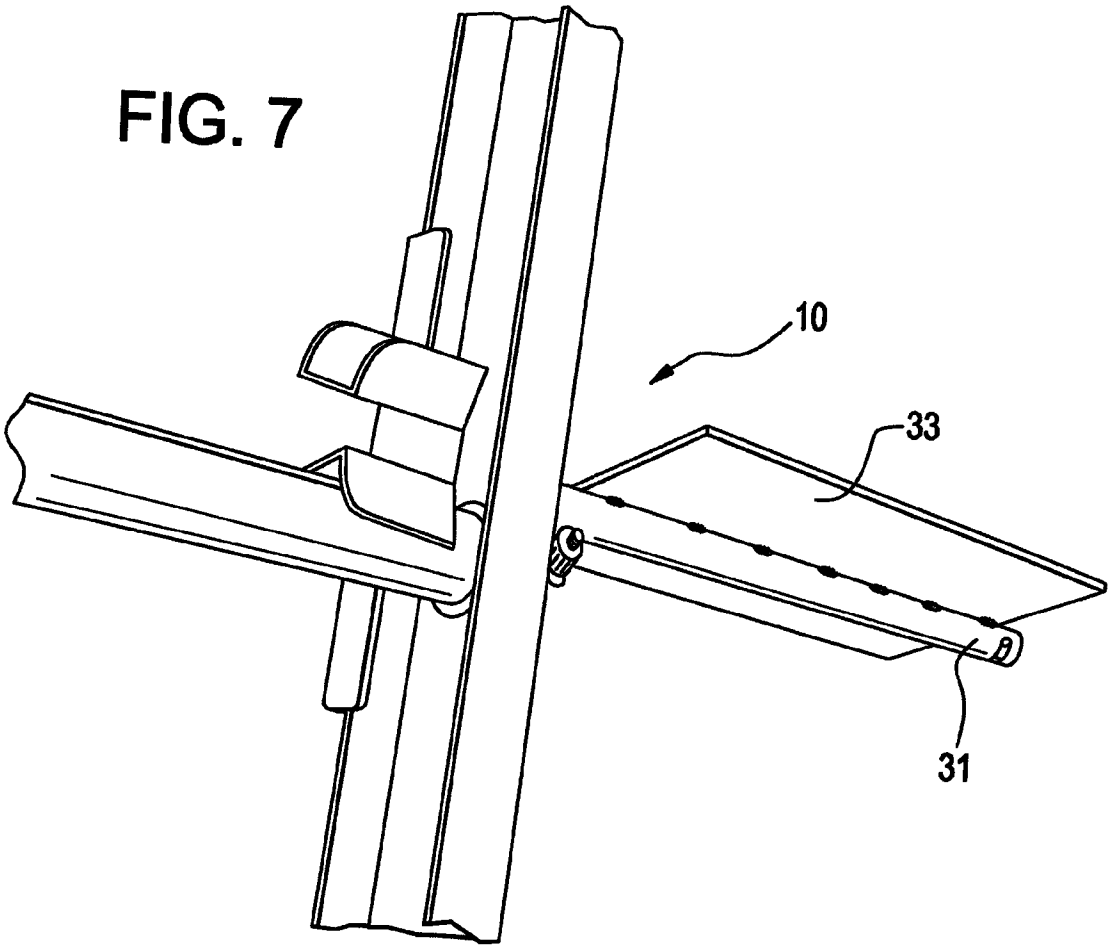
FIG. 7 shows a view similar to that of FIG. 6, but from a lower rear perspective.

As clearly seen with particular reference to FIG. 6, each of the second fittings 13 and 15 has a generally C-shaped cross-section including central sides a and parallel sides b and c attached to the central side a. The sides a, b and c are sized as seen in FIG. 6, for example, to overlie three sides of a rung such as the rung 5. The second fittings are oriented back to back, and as shown, for example, in FIG. 6, their respective central sides a are non-parallel with respect to one another.

Figure 3:
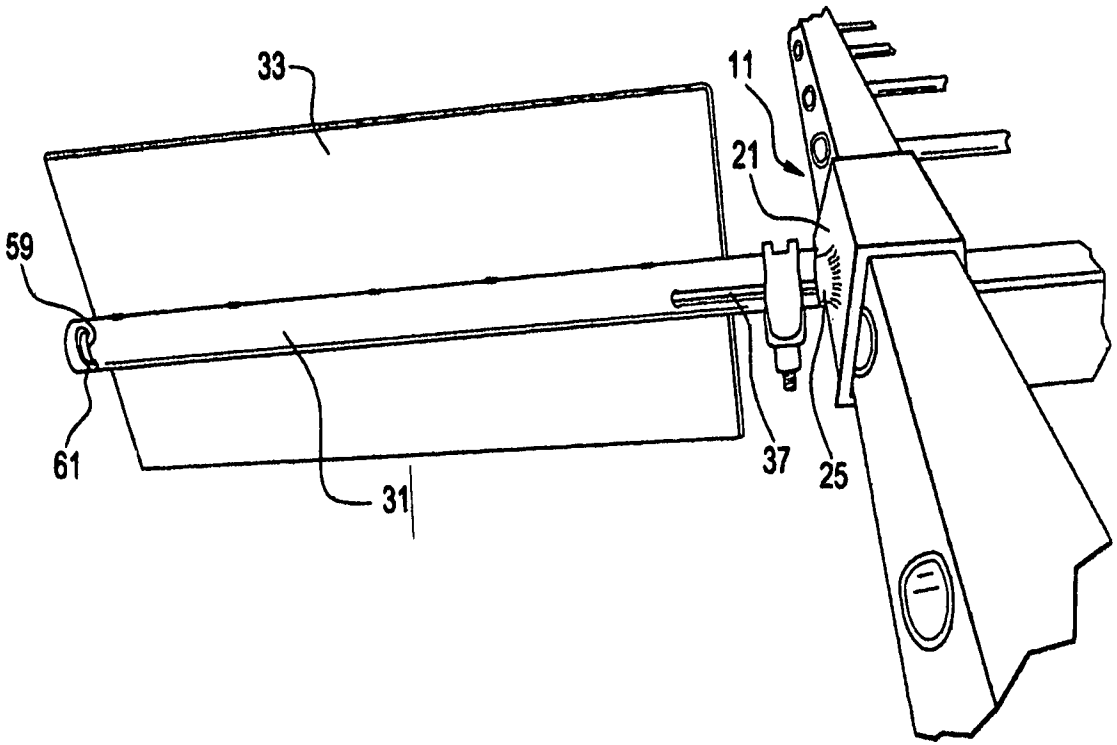
FIG. 3 shows a perspective view looking upward from below the inventive device as mounted on a ladder as shown in FIG. 2.
Figure 9:
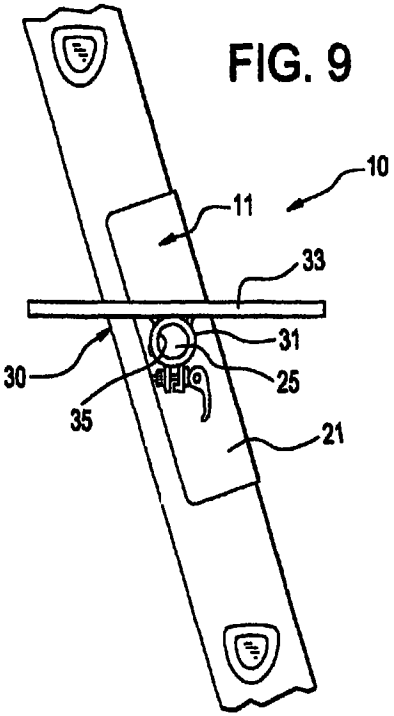
FIG. 9 shows an end view of the present invention as mounted on the ladder as shown in FIG. 8.

With reference now to, for example, FIGS. 3 and 9, it is seen that the first fitting 11 has attached thereto an elongated rod 25 that extends generally perpendicularly with respect to the wall 21 of the first fitting 11. A support is generally designated by the reference numeral 30 and includes a tube or sleeve 31 and a plate 33. The sleeve or tube 31 has a passageway 35 therethrough (FIG. 9) that allows it to freely slide over the rod 25 as shown in the figures.

Figure 4:
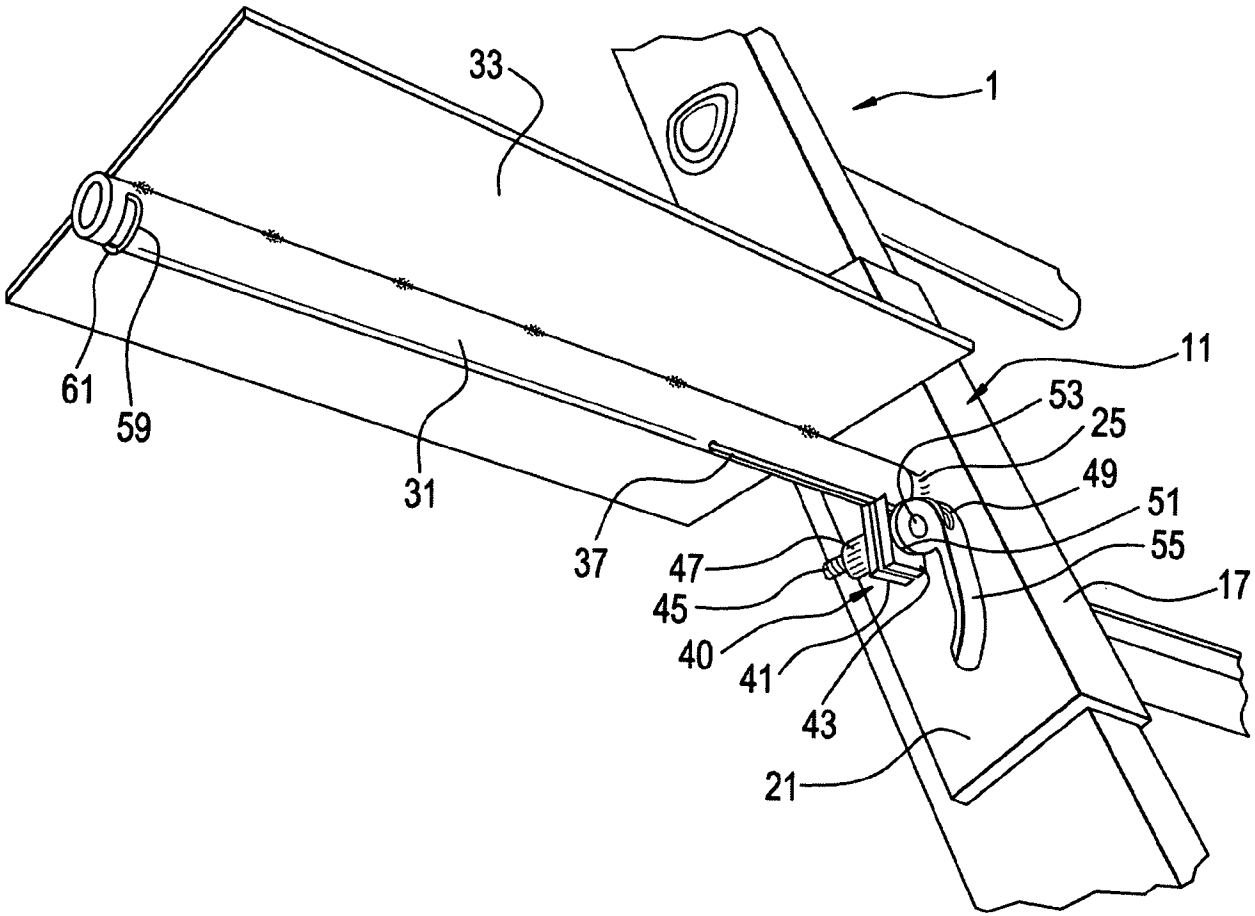
FIG. 4 shows a view similar to that of FIG. 3, but from a slightly different perspective.
Figure 5:
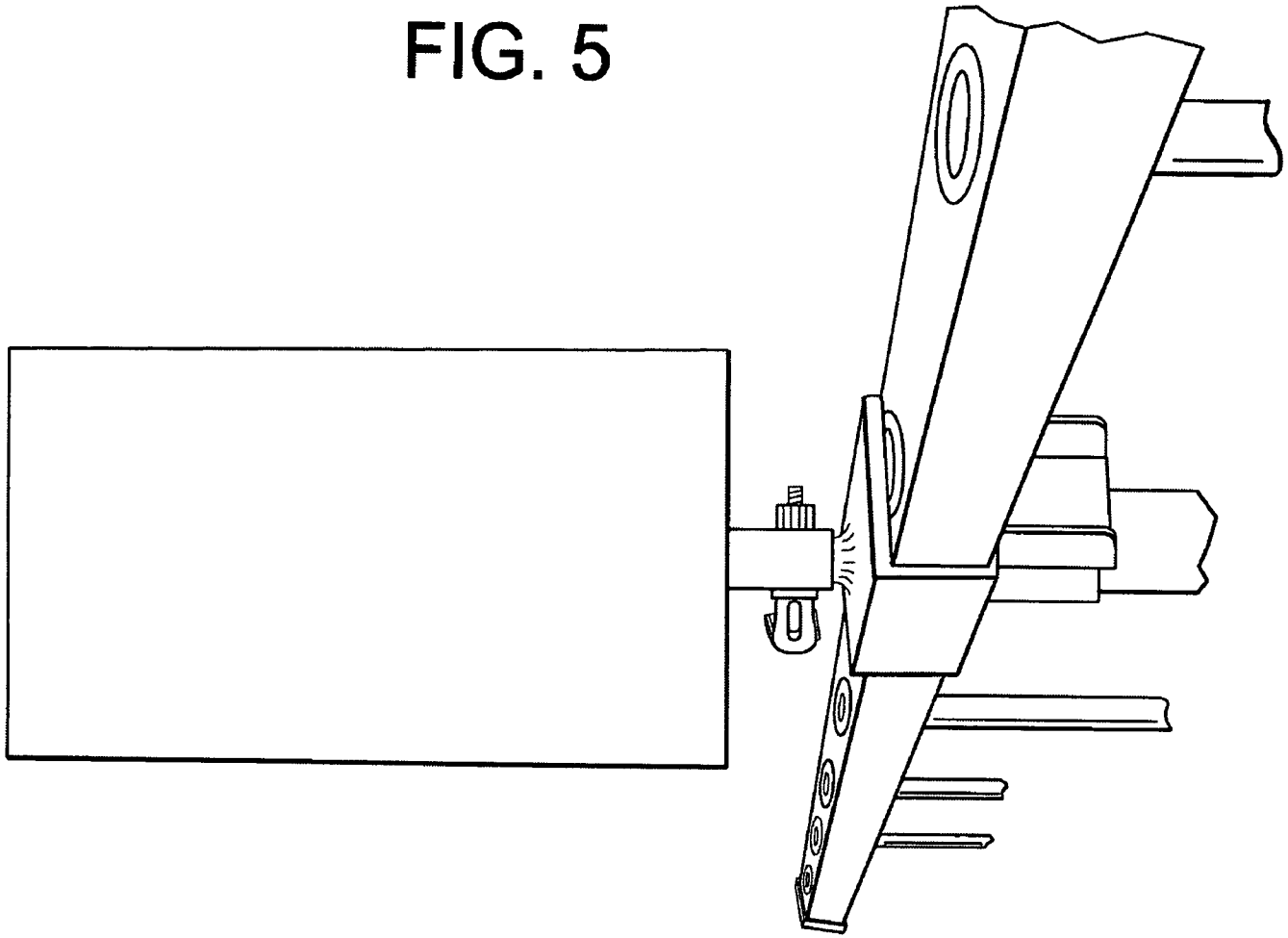
FIG. 5 shows a perspective view from above looking downward onto the inventive device as mounted on a ladder as shown in FIGS. 2-4.

In the preferred embodiment, a locking mechanism includes: the end of the tube 31 closest to the side 21 of the first fitting 11 has an elongated split 37 (for example, FIG. 3). With particular reference to FIG. 4, the locking mechanism 40 consists of plates 41 and 43 attached to the tube 31 to either side of the split 37, which plates 40 and 43 are generally parallel with respect to one another. The plates 41 and 43 have aligned holes through which a bolt 45 extends and is maintained in position by virtue of a threaded fastener 47. The other end of the bolt 45 is fastened to a cam member 49 that includes a cam surface 51 that engages an adjacent surface of the plate 43. The cam 49 is fastened to the bolt 45 by a pin 53 allowing the cam 49 to pivot with respect to the bolt 45 by gripping the handle 55 and rotating the cam surface 51. When the handle 55 is gripped and pivoted in one direction, the cam surface 51 causes the plates 41 and 43 to be moved away from one another based upon the restoring force of the material of the sleeve 31. When the handle 55 is moved in the other direction toward the orientation shown in FIG. 4, the cam surface 51 causes the plates 41 and 43 to move toward one another and thereby narrow the split 37 to cause that end of the sleeve 31 to tighten about the rod 25. This causes the sleeve 31 to be locked in its rotative orientation with respect to the rod 25. This comprises means for widening and narrowing the split 37.

With reference to FIG. 3 in particular, the sleeve 31 has a distal end at which an arcuate slot 59 is provided and the rod 25 has a projection 61 that extends into the slot 59. The interaction between the arcuate slot 59 and the projection 61 acts as a limit stop limiting the rotative orientation of the sleeve 31 with respect to the rod 25. This also serves to maintain the position of sleeve 31 along the length of rod 25, precluding the sleeve 31 from sliding off the rod 25. When it is desired to adjust the rotative orientation between the sleeve 31 and the rod 25, the cam 49 is released to enlarge the split 37 and unlock the sleeve 31 with respect to the rod 25. The rod 25 is rotated to the desired position within the limits of the interaction between the slot 59 and the projection 61. When the desired orientation is reached, the cam 49 is then tightened to narrow the slot 37 and lock the rotative position of the sleeve 31 with respect to the rod 25. In this way, the orientation of the plate 33 can be adjusted with respect to the angular position of the ladder 1.

As should be understood from the figures, the plate 33 may act as a tray to hold a variety of items laterally to the side of a ladder rail. Alternatively, a tray may be mounted onto the plate 33, either temporarily or permanently. An example of a tray is shown in FIG. 2 and designated by the reference numerals 67, 68.

With the structural details of the present invention having been explained in detail with reference to FIGS. 1-9, an explanation of the manner of use will now be made.

In using the present invention, first, the choice must be made as to whether the inventive device 10 will be attached to the rail 2 or the rail 3 of the ladder 1. If the choice is the rail 2, as shown, for example, in FIG. 1, as explained above, in the orientation of the device 10 shown in FIG. 1, the first fitting 11 is placed around the rail 2 with the second fitting 13 overlying the rung 5. In that position, the orientation of the plate 33 is adjusted by loosening the cam 49, rotating the sleeve 31 about the rod 25, and then tightening the cam 49 in the desired orientation. As explained above and with reference, for example, to FIG. 3, the rotative orientation of the plate 33 and sleeve 31 with respect to the rod 25 is limited by the extent of the slot 59 and the projection 61 of the rod 25 riding therein.

If, alternatively, it is desired to support the device 10 on the rail 3 (with reference, for example, to FIG. 2), the device 10 is removed from the rail 2 as shown in FIG. 1 and the first fitting 11 is flipped over so that, with reference to FIG. 2, now the second fitting 15 overlies the rung 5 from the other side of the rung with respect to the side shown in FIG. 1, with the first fitting 11 surrounding the rail 3 as shown in FIG. 2. The cam 49 is loosened and the sleeve 31 is rotated with respect to the rod 25 so that the desired orientation of the plate 33 is achieved, while the rotative position of the sleeve 31 with respect to the rod 25 is limited by the slot 59 and the projection 61 of the rod 25 riding therein.

With further reference, for example, to FIG. 2, as explained earlier, the plate 33 may comprise a tray itself or a tray 67 may be mounted on top of the plate 33. As shown in FIG. 2, the tray 67 includes upraised side walls 68 which serve to retain objects placed therein and to deter them from falling out of the tray 67.

In the preferred embodiment of the present invention, the component parts are made of a lightweight, strong material such as a lightweight metal like aluminum. The component parts of the inventive device 10 may also be made of such materials as wood or plastic. The locking mechanism 40, including the threaded fastener 45, bolt 47, cam 49 with its handle 55, may be a standard off-the-shelf item. Any other locking mechanism that is suitable for facilitating adjustment of the rotative position of the sleeve 31 with respect to the rod 25 and locking the rotative position of the sleeve 31 with respect to the rod 25 may also be employed.

As such, an invention has been disclosed in terms of a preferred embodiment thereof which fulfills each and every one of the objects of the present invention as set forth hereinabove, and provides a new and useful reversible ladder-mounted support and tray of great novelty and utility.

Of course, various changes, modifications and alterations in the teachings of the present invention may be contemplated by those of ordinary skill in the art without departing from the intended spirit and scope thereof.

As such, it is intended that the present invention only be limited by the terms of the appended claims.

The invention claimed is:

1. A ladder-mountable support comprising:

a first fitting having a substantially J-shape with a first side and a second side, the first fitting is configured to be mounted over either of a first rail or a second rail of a ladder, wherein said first rail is opposite to said second rail and said first side is opposite said second side;

a rod extending from said first side;

a tray mounted on the rod by a locking mechanism;

a second fitting that is substantially C-shape and configured to be mounted on a rung of the ladder, the second fitting comprising a first substantially rectangular sidewall and a second substantially rectangular sidewall perpendicularly extending from a middle plate; and a third fitting that is substantially C-shape and configured to be mounted on the rung of the ladder, the third fitting comprising a first substantially rectangular sidewall and a second substantially rectangular sidewall perpendicularly extending from a middle plate;

wherein the second and third fittings each extend from said second side such that the angle between said first substantially rectangular sidewall of said second fitting and said first substantially rectangular sidewall of said third fitting is obtuse;

wherein the first fitting is configured to be mounted on said first rail while said second fitting is mounted on the rung and said third fitting remains free;

wherein the first fitting is configured to be mounted on said second rail while said third fitting is mounted on the rung and said second fitting remains free.

2. The ladder-mountable support of claim 1, wherein said first fitting further comprises a third side, wherein said first and second sides are perpendicular to said third side.

3. The ladder-mountable support and tray of claim 1, wherein said tray is attached to a sleeve, said sleeve having an inner wall received over an outer wall of said rod.

4. The ladder-mountable support of claim 1, wherein said locking mechanism comprises an elongated split through said sleeve and a second mechanism for widening and narrowing said split.

5. The ladder-mountable support of claim 1, further including a limit stop, a sleeve wherein said limit stop is located between said rod and said sleeve, said limit stop limiting the extent of angular rotation of the sleeve about the rod.

6. The ladder-mountable support of claim 1, wherein a rod extends outwardly to support the tray wherein said tray is rotatably attached to said rod.

7. The ladder-mountable support of claim 6, further including a fastener on a bolt holding said bolt in position with respect to a first and second locking plates.

8. The ladder-mountable support of claim 3, wherein said locking mechanism comprises an elongated split through said sleeve and a second mechanism for widening and narrowing said split.

9. The ladder-mountable support of claim 8, further including a fastener on a bolt holding said bolt in position with respect to a first locking plate and a second locking plate.

10. The ladder-mountable support of claim 8, wherein said second mechanism comprises a first and second locking plates on respective edges of said split, said bolt extending through aligned holes in said plates and a cam actuator attached to said fastener.

* * * * *